US008459342B2

(12) United States Patent
O'Donnell et al.

(10) Patent No.: US 8,459,342 B2
(45) Date of Patent: Jun. 11, 2013

(54) HEAT EXCHANGER TUBE WITH INTEGRAL RESTRICTING AND TURBULATING STRUCTURE

(75) Inventors: Michael J. O'Donnell, Avon, OH (US); Terrance C. Slaby, North Royalton, OH (US)

(73) Assignee: Beckett Gas, Inc., North Ridgeville, OH (US)

( * ) Notice: Subject to any disclaimer, the term of this patent is extended or adjusted under 35 U.S.C. 154(b) by 1176 days.

(21) Appl. No.: 11/891,414

(22) Filed: Aug. 10, 2007

(65) Prior Publication Data

US 2008/0029243 A1 Feb. 7, 2008

Related U.S. Application Data

(63) Continuation-in-part of application No. 10/721,682, filed on Nov. 25, 2003, now Pat. No. 7,255,155.

(51) Int. Cl.
*F28F 13/12* (2006.01)
*F24H 3/00* (2006.01)

(52) U.S. Cl.
USPC ..... 165/109.1; 165/177

(58) Field of Classification Search
USPC ..... 165/109.1, 177, 184, 131, 179; 126/99 R, 126/110 R; 138/38, 42, 43
See application file for complete search history.

(56) References Cited

U.S. PATENT DOCUMENTS 755,558 A * 3/1904 Barber ..... 138/38
910,192 A 1/1909 Grouvelle et al.
1,018,156 A 2/1912 Beyer
1,315,853 A 9/1919 Nordling
1,780,110 A 10/1930 Bliss
1,922,838 A * 8/1933 Bossart ..... 165/177
1,991,788 A * 2/1935 Cartter ..... 138/38
2,016,720 A 10/1935 Krause
2,080,626 A * 5/1937 Mojonnier ..... 138/38
2,252,045 A 8/1941 Spanner
2,591,235 A * 4/1952 Cartter ..... 126/91 A
2,663,321 A 12/1953 Jantsch
3,230,936 A * 1/1966 Cleaver et al. ..... 122/149
3,232,280 A 2/1966 Loebel et al.
3,358,749 A 12/1967 Chisholm et al.
3,481,394 A 12/1969 Withers, Jr.
3,757,856 A 9/1973 Kun (Continued)

FOREIGN PATENT DOCUMENTS

DE 2408886 9/1975
DE 19731190 1/1999

*Primary Examiner* — Tho V Duong
(74) *Attorney, Agent, or Firm* — Tarolli, Sundheim, Covell & Tummino LLP

(57) ABSTRACT

A heat exchanger tube having an integral restricting and turbulating structure consisting of dimples formed by confronting indentations pressed into the sides of the heat exchanger tube. The dimples are comprised of indentations disposed in pairs which extend into the tube to such a depth as is necessary to significantly reduce the cross sectional area of the heat exchanger tube. The dimples of a pair are staggered or offset, longitudinally with respect to each other such that a restrictive passage is defined between each pair of offset dimples. The turbulence characteristics of the tube can be controlled by varying the depth to which the dimples project into the tube and the longitudinal spacing between the dimples that comprise the pair. Adjacent pairs of dimples may be rotated 90° with respect to each other or alternately can be arranged in a helix pattern.

15 Claims, 6 Drawing Sheets

U.S. PATENT DOCUMENTS

| | | | | | |
|---|---|---|---|---|---|
| 4,014,962 | A | * | 3/1977 | del Notario | 261/112.1 |
| 4,332,294 | A | | 6/1982 | Drefahl et al. | |
| 4,353,350 | A | | 10/1982 | Albrecht | |
| 4,368,777 | A | | 1/1983 | Grasso | |
| 4,451,966 | A | | 6/1984 | Lee | |
| 4,580,657 | A | | 4/1986 | Schmeichel et al. | |
| 4,585,059 | A | | 4/1986 | Lee | |
| 4,589,481 | A | | 5/1986 | Mansson | |
| 4,690,211 | A | | 9/1987 | Kuwahara et al. | |
| 4,715,436 | A | | 12/1987 | Takahashi et al. | |
| 5,094,224 | A | * | 3/1992 | Diesch | 126/110 R |
| 5,186,250 | A | | 2/1993 | Ouchi et al. | |
| 5,251,693 | A | | 10/1993 | Zifferer | |
| 5,271,376 | A | | 12/1993 | Lu et al. | |
| 5,311,661 | A | | 5/1994 | Zifferer | |
| 5,321,661 | A | | 6/1994 | Iwakiri et al. | |
| 5,336,082 | A | | 8/1994 | Riehl | |
| 5,375,654 | A | | 12/1994 | Hougland et al. | |
| 5,409,057 | A | | 4/1995 | Zifferer | |
| 5,573,062 | A | | 11/1996 | Ooba et al. | |
| 5,689,881 | A | | 11/1997 | Kato | |
| 5,839,505 | A | * | 11/1998 | Ludwig et al. | 165/109.1 |
| RE37,009 | E | | 1/2001 | Diesch | |
| 6,422,306 | B1 | * | 7/2002 | Tomlinson et al. | 165/170 |
| 6,945,320 | B2 | * | 9/2005 | Harvard et al. | 165/109.1 |
| D514,338 | S | | 2/2006 | Bellin | |

* cited by examiner

HEAT EXCHANGER TUBE WITH INTEGRAL RESTRICTING AND TURBULATING STRUCTURE

RELATED APPLICATION

This is a continuation-in-part application of U.S. Ser. No. 10/721,682, filed on Nov. 25, 2003 now U.S. Pat. No. 7,255, 155.

TECHNICAL FIELD

The invention relates to appliances which employ tubular elements for the purpose of conveying flue products and transferring heat to fluid media adjacent to the exterior of the tube. Product groups include, but are not limited to, furnaces, water heaters, unit heaters and commercial ovens.

BACKGROUND

A typical method of making heat exchangers for a variety of gas and oil fired industrial or residential products is to bend a metal tube into a serpentine shape thereby providing multiple passes. Gases heated by a burner at one end of the heat exchanger travel through the tube interior and exit the other end of the heat exchanger. While the hot flue gases are within the tube, heat is conducted through the metal walls of the tube and transferred to the air or other fluid media surrounding the tube thereby raising its temperature. In order to achieve efficient heat transfer from the tubes, it is usually necessary to alter the flow of gases by reducing their velocity and/or promoting turbulence, mixing and improved contact with the tube surface. A typical method for achieving this is by placing a separate restrictive turbulating baffle inside the tube. These baffles are typically metal or ceramic. One problem associated with baffles in tubes is noise caused by expansion or contraction of baffles or vibrations generated by the mechanical coupling to components such as blowers or fans. Another difficulty related to the use of baffles is that the heat exchanger tube cannot be bent with a baffle already inserted so that baffles must be inserted after bending, limiting the typical location of baffles to straight sections of the heat exchanger tube which are accessible after bending. In addition, the use of separate baffles increases the cost and difficulty of assembling the heat exchanger.

A known alternative to baffles is the technique of selectively deforming the tube to change its cross section. Such deformation causes a restriction to the gas flow due to the change in cross section, achieving the effect of baffles. For example a known method is to flatten sections of the tube to achieve the desired restriction. A problem with the use of flattened sections is that this technique extends the cross section of the tube beyond that of the tube without deformations, creating low spots in horizontal sections. Additionally, the flattened sections prevent the tube from passing through a hole of approximately the tube outside diameter as required for assembly in some applications.

While deformation of the heat exchanger tube can replace the use of baffles in some applications, the deformation technique has had less than satisfactory results when applied in commercial and light commercial heating and air conditioning units. The design of most heating and air conditioning units is such that the heat exchanger is located downstream of the evaporator section for cooling. Therefore, during use for air conditioning the cool air passing over the heat exchanger lowers the tube temperature below the dew point of air inside the tube, resulting in condensation inside the tube. Current configurations of tube deformation experience problems in draining this condensation from the tube due to low spots in the horizontal sections of the tube. The low spots, which are caused by restricting deformations prevent the flow of liquid, allowing condensate to puddle and increase the likelihood of corroding the tube. For this reason baffles are often used in heating and air conditioning unit heat exchangers to avoid premature failure due to corrosion.

SUMMARY OF THE INVENTION

An object of the present invention is to provide a single piece heat exchanger tube which incorporates an integral restricting and turbulating structure and is suitable for use in residential heating, commercial heating/air conditioning and cooking units.

A more particular object of the present invention is to provide a heat exchanger tube with an integral restricting and turbulating structure which allows for drainage of liquid from the tube even when located in a horizontal section of the tube. Another more particular object of the invention is to provide a heat exchanger tube which can have integral restricting and turbulating structures between bends in a serpentine shaped heat exchanger.

The heat exchanger tube of the present invention generally comprises a metal tube having open ends. At one end is an inshot gas burner which heats gases flowing into the tube. Hot gases which have flowed through the length of the tube are exhausted out the other end of the tube. In many applications, the tube is bent into a serpentine shape to form several passes.

In order to maximize the efficient transfer of heat from the hot gases within the tube to the air or other fluid media outside the tube, a restricting and turbulating structure is used to slow the rate of travel of the hot gases through the tube. The restricting and turbulating structure of the present invention comprises dimples formed in the sides of the heat exchanger tube. The heat exchanger tube with dimples pressed in it maintains a cross sectional profile that does not extend beyond that of the undimpled tube, preventing difficulties associated with flattening techniques. The dimples are comprised of pairs of indentations opposite one another along the tube. The indentations may extend into the tube to such depth as is necessary to provide the required restriction. These indentations are located directly opposite from each other, constituting a dimple which significantly reduces the cross sectional area of the tube. This dimple form provides a structure approximating a pair of converging, diverging nozzles. This two nozzle dimple structure provides improved turbulence. In applications requiring condensate drainage, the dimples are preferably located only along the sides of the tube, with the axis of the dimple being perpendicular to the vertical centerline of the tube as it is oriented in use. This provides a non-deformed tube along the bottom of the horizontal sections, which provides liquid condensate and an unobstructed flow path. In short, the dimples do not obstruct the flow of liquid out of the tube. Exact dimple geometry and location may be adjusted to maximize efficient turbulence of the hot gases, depending on the final shape and orientation of the tube.

According to another embodiment of the invention, the heat exchanger apparatus includes a tubular member wherein the restricting and turbulating structure comprises at least one pair of offset obstructions, each obstruction having a generally parabolic dimple shape. Each obstruction of a pair projects into the tubular member. In a more preferred embodiment, the obstructions of a pair are spaced longitudinally but are aligned transversely.

Each obstruction of a pair projects into the tubular member such that a restricted passage is defined between the obstructions or dimples. The extent to which the obstructions project into the tubular member and the longitudinal spacing between the obstructions of a pair determine the restriction imposed by the restricted passage defined there between.

According to one feature of this embodiment, an adjacent pair of dimples are rotated 90° with respect to adjacent pairs of dimples. According to another feature of this embodiment, the adjacent pairs of dimples are positioned in a helix pattern. In this latter embodiment, adjacent pairs of dimples are located at rotated positions that are less than 90°. By arranging the pairs of dimples in a helix pattern, a greater number of dimples can be formed in a given length of tube as compared to arrangements where the pairs of dimples are rotated 90° with respect to each other.

The present invention provides a heat exchanger tube suitable for use in commercial and light commercial heating and air conditioning units as well as other commercial and residential products. The present invention incorporates an effective restricting and turbulating structure which does not require additional parts such as baffles. The present invention provides a heat exchanger tube having a cross section which does not extend outside the cross section of the heat exchanger tube without dimples. In addition, the present invention does not interfere with drainage of condensation, even when the heat exchanger tube is bent into a serpentine shape, thereby reducing the possibility of corrosion. In applications where condensate drainage is not an issue, dimples can be located rotationally at any desired angle from each other to provide additional mixing and turbulence. The present invention also provides a superior turbulating method by providing adjacent converging, diverging nozzles in a tubular heat exchanger regardless of shape or tube orientation. The turbulating characteristics of the present invention can be controlled by controlling an aperture size of the nozzles or the depth and longitudinal spacing of the dimples.

Other objects and advantages and a fuller understanding of the invention will be had from the following detailed description of the preferred embodiments and the accompanying drawings.

DESCRIPTION OF PREFERRED EMBODIMENT

FIGS. 1-9 illustrate the construction of heat exchanger tubes 10, 30, 10' constructed in accordance with preferred embodiments of the invention. The heat exchanger tube of the present invention may be used in many heating applications including, but not limited to, furnaces, water heaters, unit heaters and commercial ovens.

Figure 7:
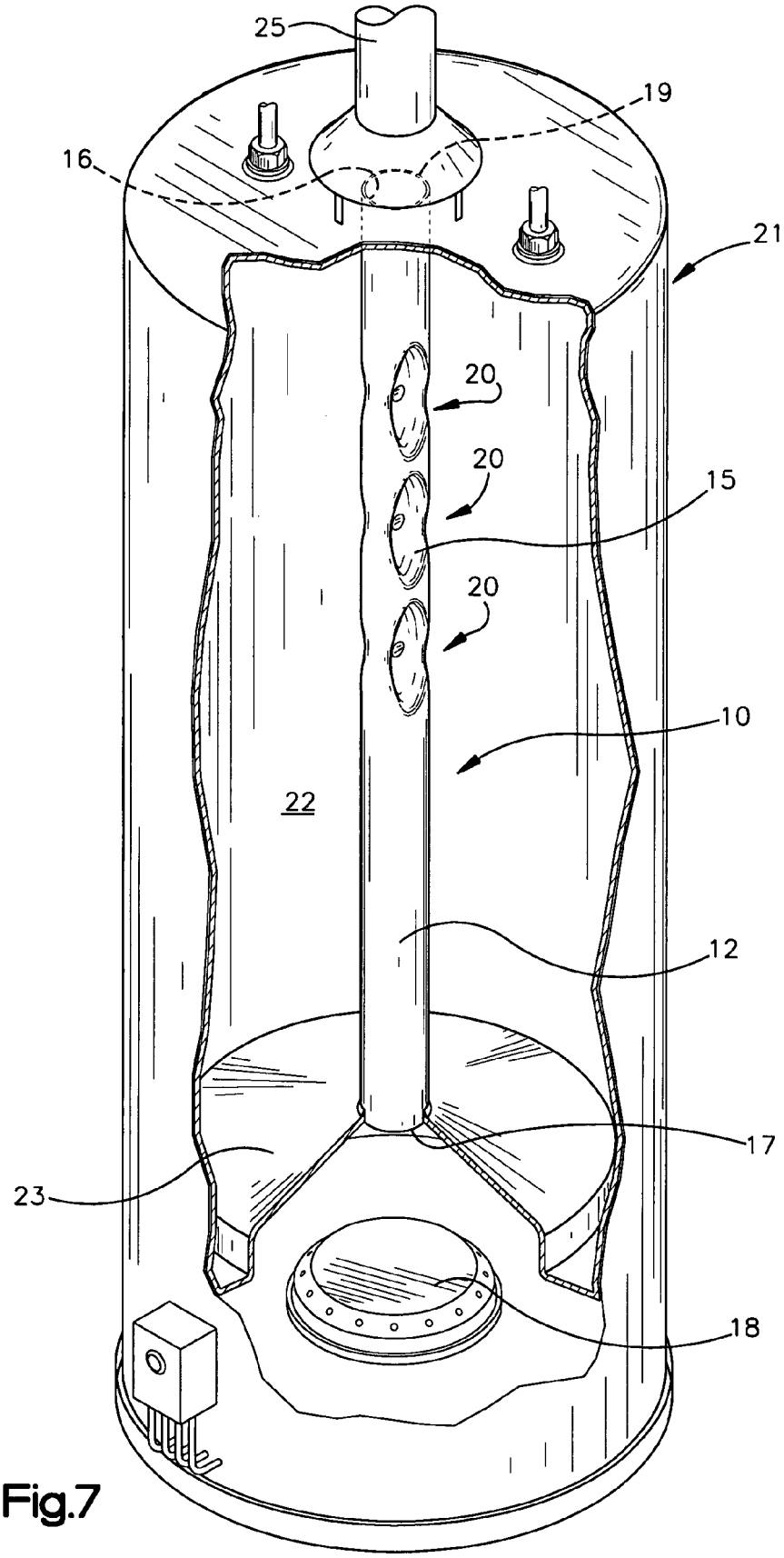
FIG. 7 is cut away view of a residential/light commercial water heater having a flue tube made in accordance with the present invention, instead of a baffle as used in current practice.

To facilitate the explanation, the tube construction shown in FIGS. 1-4 will be described first in connection with its use as a flue tube in a water heater (shown in FIG. 7). Referring also to FIG. 7, a gas heated residential water heater 21 is shown having a flue tube 10 of the present invention extending upwardly through a water heating chamber 22. The flue tube 10 consists primarily of a metal tube 12. The metal tube 12 has an interior surface 16, an inlet end 17, and an outlet end 19. At least one parabolic shaped indentation 15 is pressed into the metal tube 12. In the preferred embodiment, the indentations 15 are pressed into the metal tube 12 in pairs located across the tube 12 from one another to the depth necessary to provide the desired restriction, up to the point of contacting the opposite indentation, see FIG. 2. Confronting/opposing indentations 15, together define a dimple 20. The number of dimples 20 used as well as the exact shape of the dimples may be adjusted to vary the restricting and turbulating characteristics of the flue tube 10. As seen in FIG. 7, a gas burner 18 is disposed at the tube inlet end 17 which heats gases that move through the tube 10 and are exhausted through the outlet end 19 and into the water heater vent system 25. The heat from these gases is conducted through the walls of the metal tube 10 to heat the water in the water heating chamber 22. The illustrated dimple structure when used in a water heater application, is more resistant to deformation and/or collapse of the tube 10 due to hydrostatic forces exerted by the water in the heating chamber 22, as compared to prior art tube forming or flattening methods.

Figure 1:
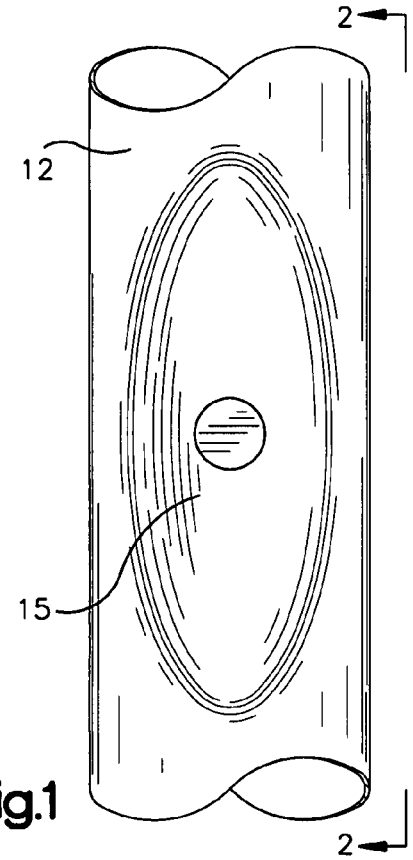
FIG. 1 is a side plan view of a portion of a heat exchanger tube made in accordance with the present invention.
Figure 2:
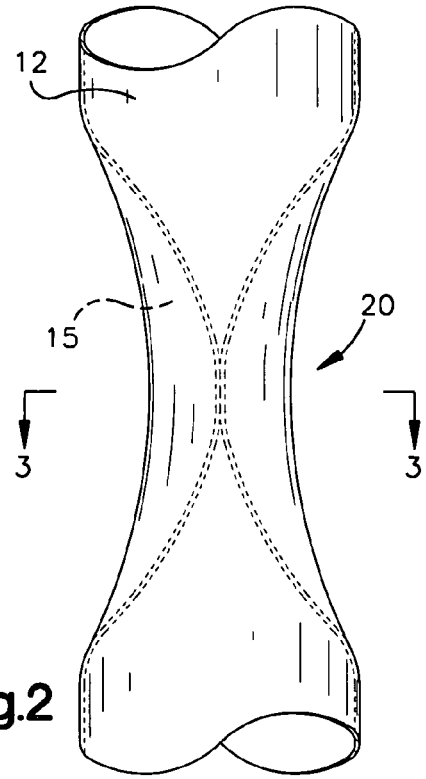
FIG. 2 is a top plan view of the heat exchanger tube as seen from the plane indicated by the line 2-2 in FIG. 1.

FIGS. 1-4 show the heat exchanger tube 10 in detail. FIG. 1 shows the indentations 15 which preferably have a parabolic shape and are disposed in opposing or confronting pairs to constitute the dimple 20, positioned along the length of the metal tube 12 so as to significantly reduce the cross sectional area of the tube. Each indentation 15 may contact the indentation 15 opposite it to form an interior cross section shown in FIGS. 3A and 3C, or it may confront the opposing indentation without contact resulting in significant reduction of the cross sectional area as in FIG. 3B.

A maximum spacing of the confronting indentations 15 of about 12% of the tube diameter is appropriate for practice of the invention. In this manner, the indentations form a pair of adjacent, converging/diverging nozzles in the tube to enhance the heat transfer by disrupting the fluid boundary layer at the inner tube surface. The expanding fluid streams exiting the nozzle interact to produce turbulence downstream even at low Reynolds flow numbers (low flow velocities). An aperture 31 of each of the adjoining nozzles is controlled by the depth of the confronting indentations 15. Controlling the aperture opening of the nozzles allows precise control of pressure drop through the tube and the flow characteristics as necessary to conform to the design of the tube (i.e. the number of serpentine passes and length of each pass) and the product to which the tube will be applied.

Figure 3A:
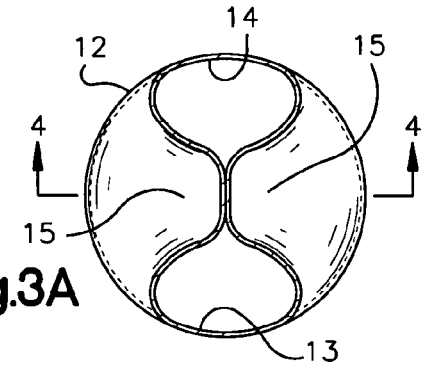
FIG. 3A is a section view taken along line 3-3 of FIG. 2 of an embodiment of the present invention.
Figure 3B:
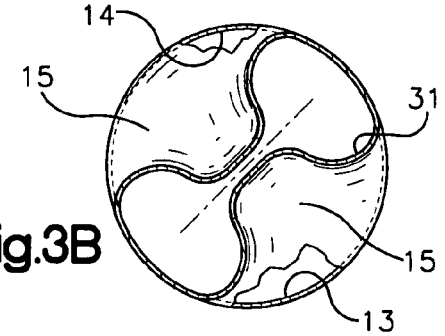
FIG. 3B is a section view taken along line 3-3 of FIG. 2 of an embodiment of the present invention.

When the indentations do not contact one another as in FIG. 3B, the space between the indentations 15 remains a dead flow area@ within a range of spacing between 0-12% of tube diameter, allowing control of the flow and pressure drop characteristics of the nozzle by controlling the size of the apertures 31. The size of the apertures 31 can be selected by varying the depth of the indentations 15, allowing the use of a single tool form design for each tube diameter and aperture size. This permits optimization of the tube(s) 10 for heat transfer and efficiency in the exchanger design with respect to cabinet configuration and external circulating airflow.

Figure 3C:
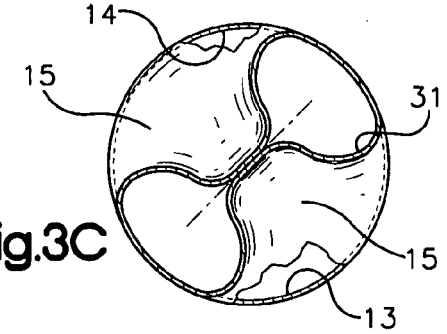
FIG. 3C is a section view taken along line 3-3 of FIG. 2 of an embodiment of the present invention.
Figure 4:
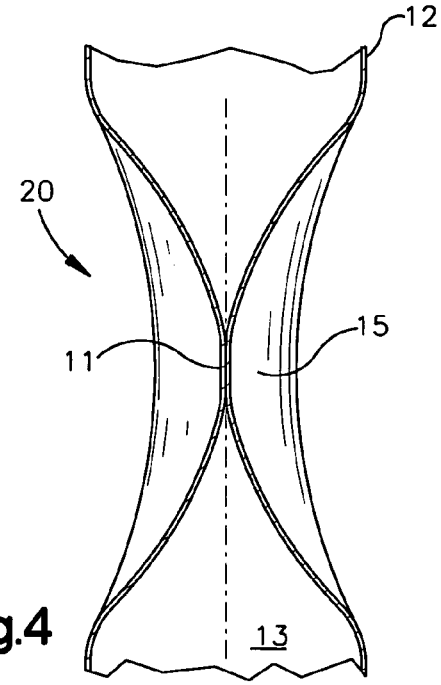
FIG. 4 is a section view taken along line 4-4 of FIG. 3.
Figure 6:
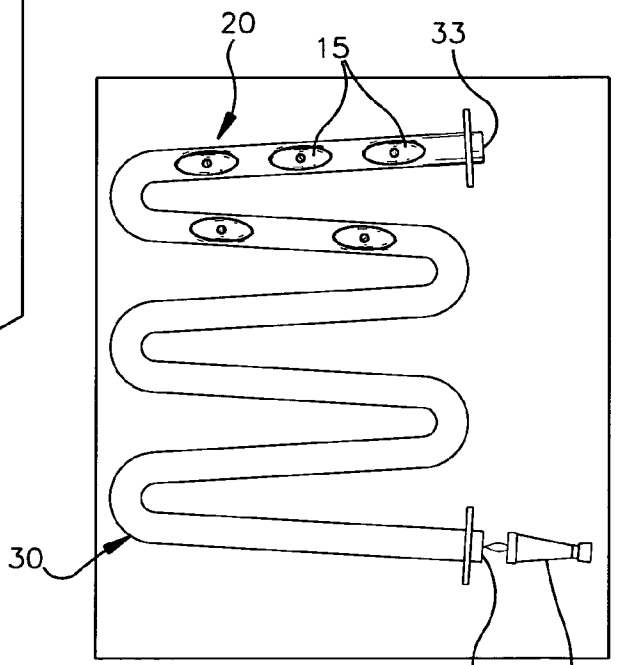
FIG. 6 is a side plan view of the heat exchanger tubes of FIG. 5.
Figure 5:
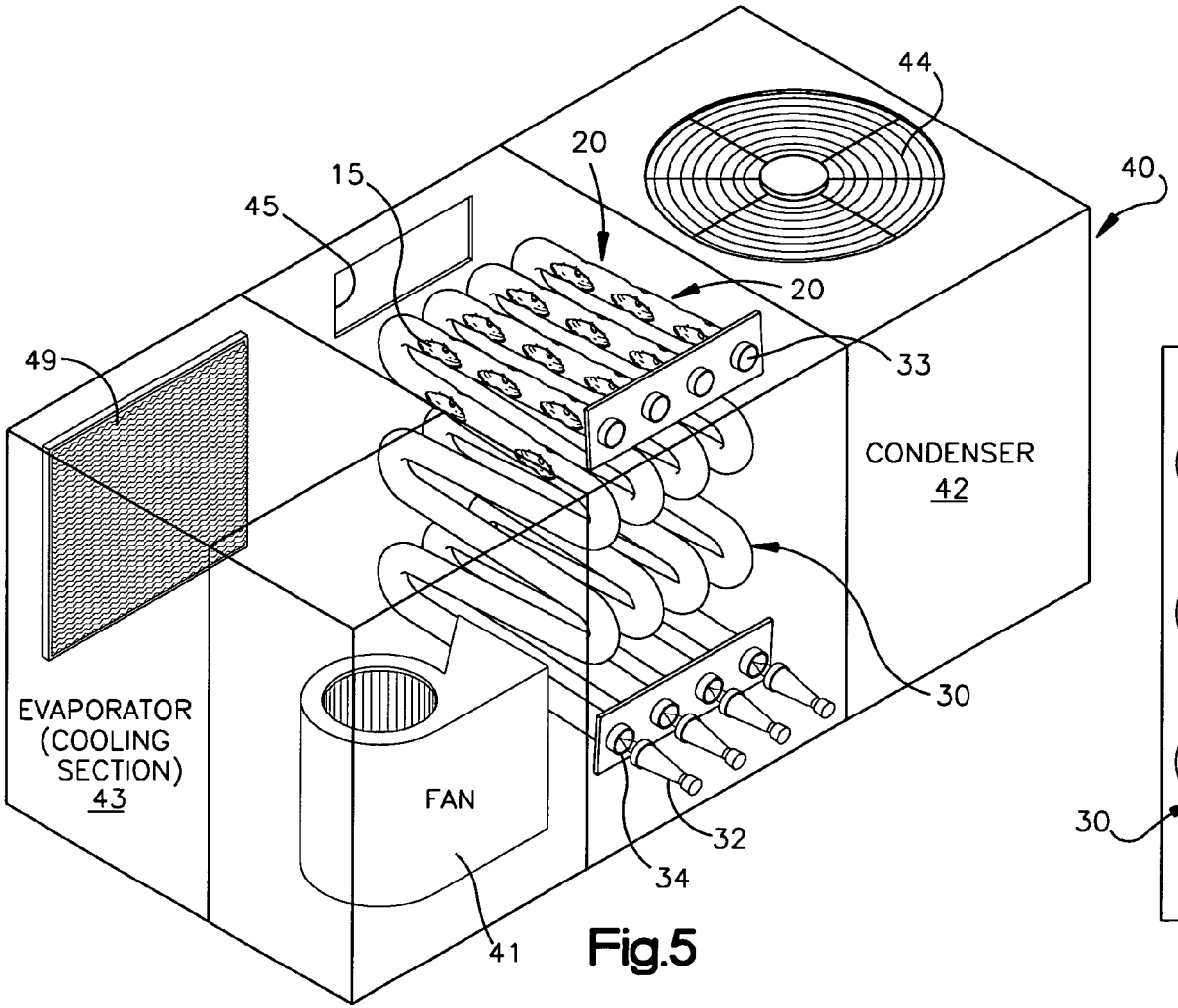
FIG. 5 is a perspective view of a heating and air conditioning unit having heat exchanger tubes made in accordance with the present invention.

In some applications (and as will be described in connection with FIGS. 5 and 6), the dimples 20 are located only along the sides of the metal tube 12 (see FIG. 3A) so that the bottom interior surface 13 is free from obstruction by dimples to allow drainage of fluid from the heat exchanger tube 10 even when the heat exchanger tube is bent into a serpentine shape as shown in FIG. 5. By locating the dimples on a 0-45° axis relative to the vertical axis as shown in FIGS. 3B and 3C (a 45° angle is depicted in both Figures), the top, bottom, and side interior surfaces 14, 13, and 36 respectively of the tube 10 may be made free from the obstruction by dimples to allow for drainage of fluid when the tube is bent along the vertical or horizontal axis. The heat exchanger tube 10 maintains circular cross sectional profile after dimples 20 have been installed as can be seen in FIGS. 3A-3C and 4. FIG. 1 shows a side plan view of the heat exchanger tube 10 with a dimple 20. At the center of each indentation 15 is an area 11 which is the area 11 over which the indentation 15 may contact the indentation opposite it. FIGS. 3A-3C show an interior view of the dimple 20 having nozzle-like structure.

FIG. 5 shows a plurality of serpentine shaped heat exchanger tubes 30 used in a heating and air conditioning unit 40. The heat exchanger tube 30 has six passes. Although dimples 20 are shown only in two passes of the metal tube 12, they may be located anywhere along the length of the metal tube at the designer's discretion. An inshot burner 32 is disposed at each heat exchanger tube inlet end 34.

When the heating and air conditioning unit 40 is used as a furnace, the burners 32 heat gases which pass through the six passes of the serpentine shaped heat exchanger tube 30. A fan 41 blows air across the heat exchanger tube 30 to be heated. Hot air then moves from the heating and air conditioning unit 40 via a duct 45. When the heating and air conditioning unit 40 is used as an air conditioner, the burners 32 are not lit. Refrigerant is vaporized in the evaporator 43, causing the coils 49 of the evaporator 43 to become cold. The fan 41 draws air across the evaporator coils 49 where it is cooled and moves across the heat exchanger tube 30 prior to moving out of the heating and air conditioning unit 40. The refrigerant is then moved to the condenser 42 where it returns to liquid form. When the cold air moves across heat exchanger tube 30, the temperature of the air within the heat exchanger tube 30 cools to below the dew point, forming condensation within the heat exchanger tube 30. In most cases, the horizontal passes of the tube are parallel. Condensation does drain and does not pool in any portion of the tube. In the example shown, condensation drains more positively out of the heat exchanger tube 30 due to the constant downward slope of the horizontal portions of the tube. Since the dimples 20 are located only along the sides of the heat exchanger tube 30, the flow of condensation is unobstructed and hence no pooling of condensation occurs within the heat exchanger tube 30.

Figure 8:
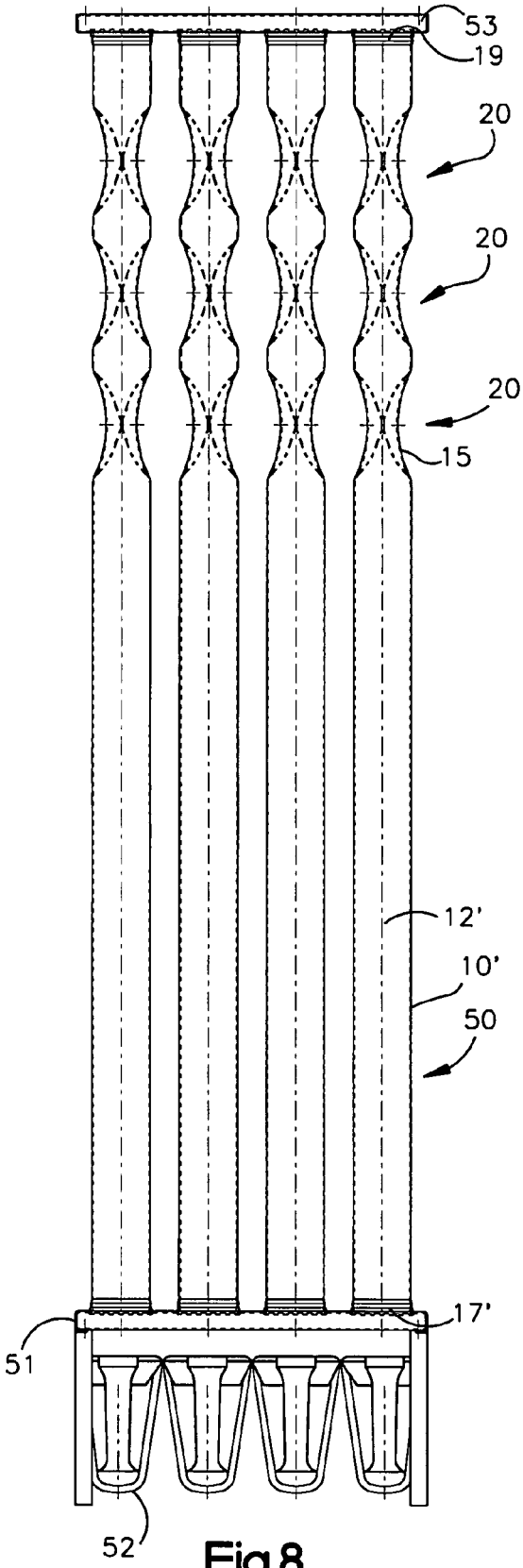
FIG. 8 is a front plan view of a plurality of heat exchanger tubes made in accordance with the present invention.
Figure 9:
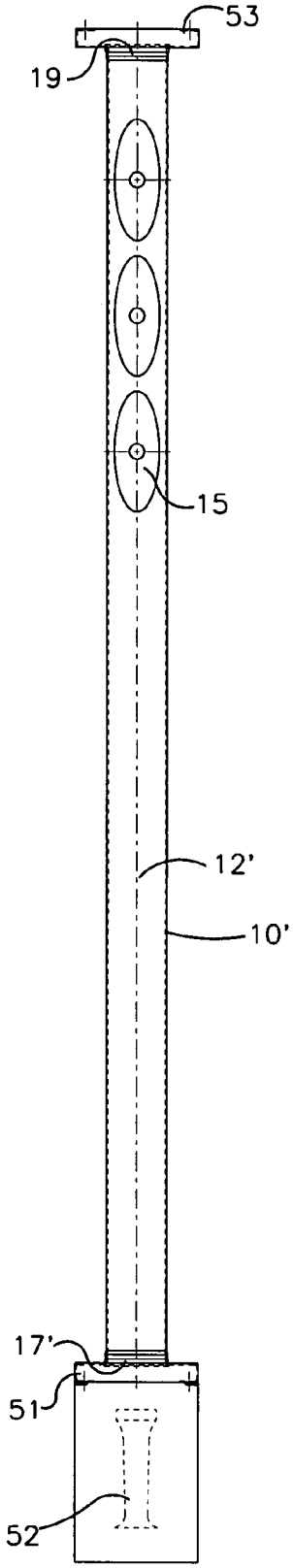
FIG. 9 is a side plan view of the heat exchanger tubes of FIG. 8.

Referring to FIGS. 8 and 9, a heat exchanger tube set 50 for use in a vertical gravity type gas wall furnace is shown having a plurality of heat exchanger tubes 10' of the present invention. The inlet ends 17' are connected to a header plate 51 with gas burners 52 connected on the other side of the header plate to provide heat to the gases within the heat exchanger tube 10'. The outlet ends of the heat exchanger tubes are connected to an outlet bracket 53 where the heated gases are exhausted. See the explanation for FIGS. 1-4 above for the specific operation of the heat exchanger tubes 10' in this embodiment. As with the other disclosed embodiments, the dimples 20 may be disposed at any location along the length of the metal tube 12' as per design requirements.

FIGS. 10-14 illustrate other preferred embodiments of the invention. These alternate embodiments of the invention can be used in hot water tank applications as well as the furnace applications described above.

Figure 10:
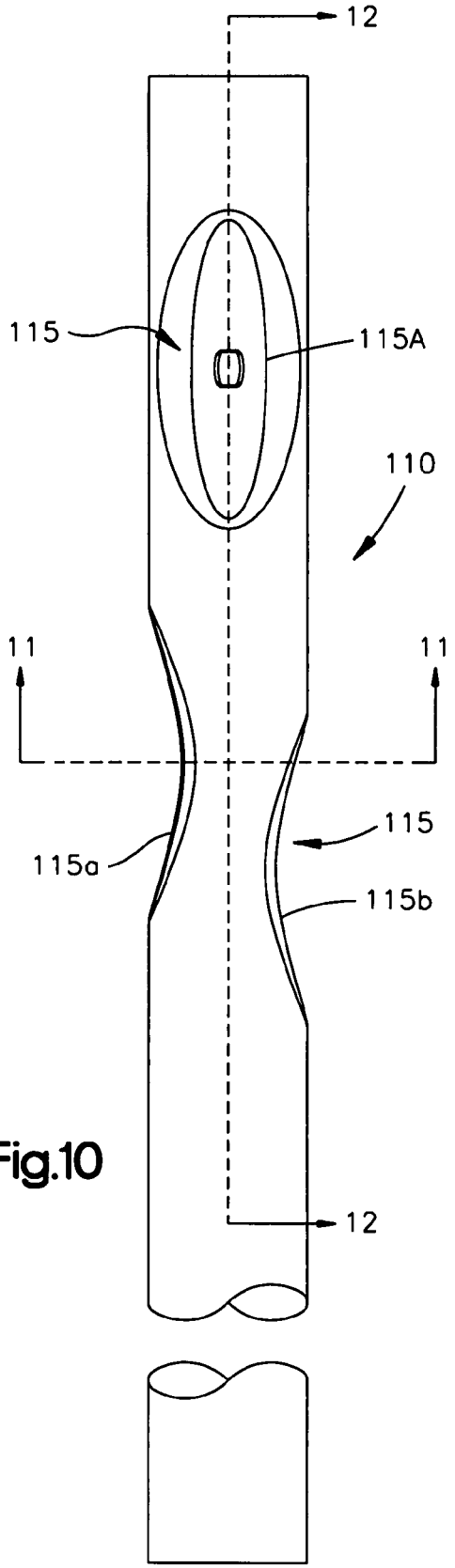
FIG. 10 is a side plan view of a portion of a heat exchanger tube made in accordance with another embodiment of the invention.

One of the alternate constructions is shown in FIG. 10 and includes a tube 110 in which a plurality of dimples 115 are formed. In this alternate construction, the dimples are arranged in pairs such as 115*a*, 115*b* but unlike the dimples 15 in FIGS. 1-4, the dimples 115*a*, 115*b* are staggered or offset with respect to each other. The dimples of a pair are not both longitudinally and transversely aligned and do not directly confront each other. The dimples 115*a*, 115*b* may be shaped like the dimples 15 in FIGS. 1-4 i.e. parabolic, etc.

Figure 12:
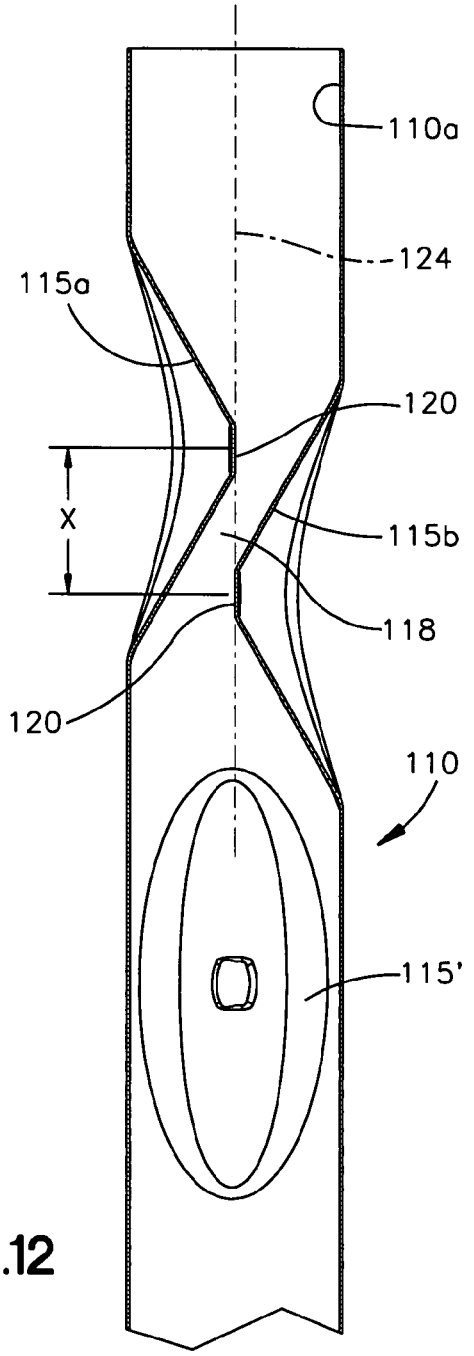
FIG. 12 is a sectional view of the heat exchanger tube as seen from the plane indicated by the line 12-12 in FIG. 10.

As seen best in FIG. 12, the pair of staggered dimples 115*a*, 115*b* defines a restricted passage 118. The depth to which the dimples 115*a*, 115*b* project into the interior 110*a* of the tube 110, at least partially determines the extent of restriction that is created by the passage 118. In FIG. 12, each dimple of the dimple pair 115*a*, 115*b* extends to a depth in the tube 110 such that an innermost region 120 is coincident with a center plane of the tube as indicated by the dashed line 124. In accordance with the invention, the dimples 115*a*, 115*b* can be formed with the regions 120 projecting beyond the center plane 124 which would produce a more restrictive passage 118 or, alternatively, can be formed so that the regions 120 are spaced away from the center plane 124. The present invention also contemplates dimple pairs 115*a*, 115*b* in which the regions 120 project to the same or different depths.

According to a further feature of this embodiment, the restriction posed by the passage 118 is also controlled by the axial or longitudinal spacing between the pair of dimples 115*a*, 115*b*. This distance "x" when increased, produces a passage 118 with less restriction. As the "x" dimension is decreased, i.e., the dimples 115*a*, 115*b* are brought closer together, the restriction posed by the passage 118 is increased. The maximum restriction is realized when "x" equals "0" and this is the embodiment shown in FIGS. 1-4.

Figure 11:
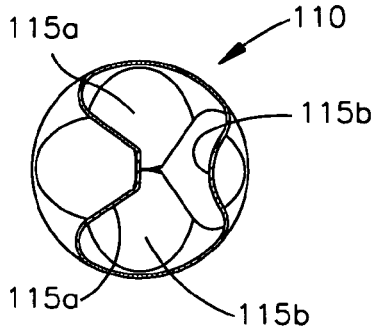
FIG. 11 is a sectional view of the heat exchanger tube as seen from the plane indicated by the line 11-11 in FIG. 10.

In accordance with this embodiment, another offset or staggered pair 115' of dimples (shown only in FIG. 12 are also formed in the tube 110 and are preferably located at positions that are rotated from the positions of the dimples 115*a*, 115*b* In the embodiment illustrated in FIGS. 10-12, subsequent pairs of staggered dimples are positioned 90° with respect to the dimple pair 115*a*, 115*b*.

Figure 13:
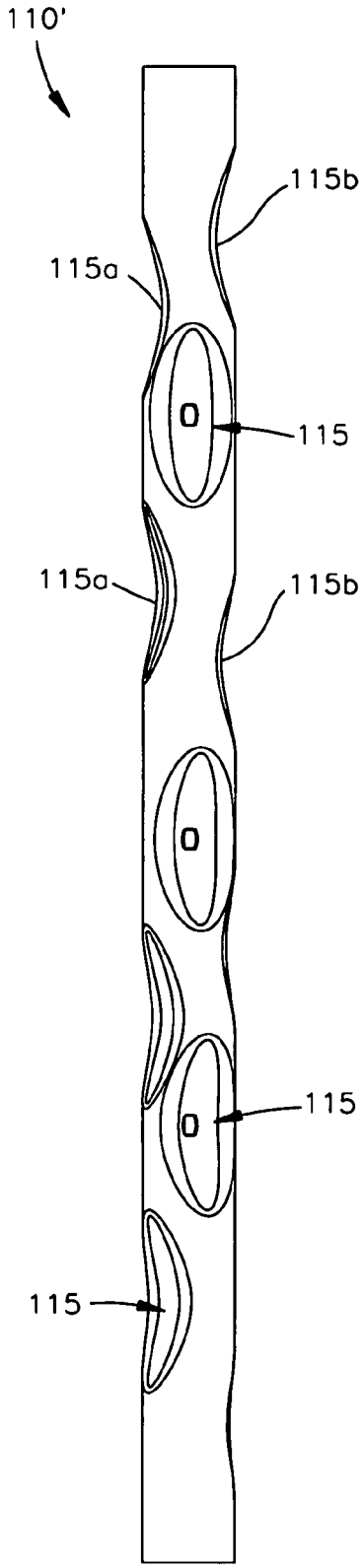
FIG. 13 is a side plane view of a portion of the heat exchanger tube made in accordance with another preferred embodiment of the present invention.
Figure 14:
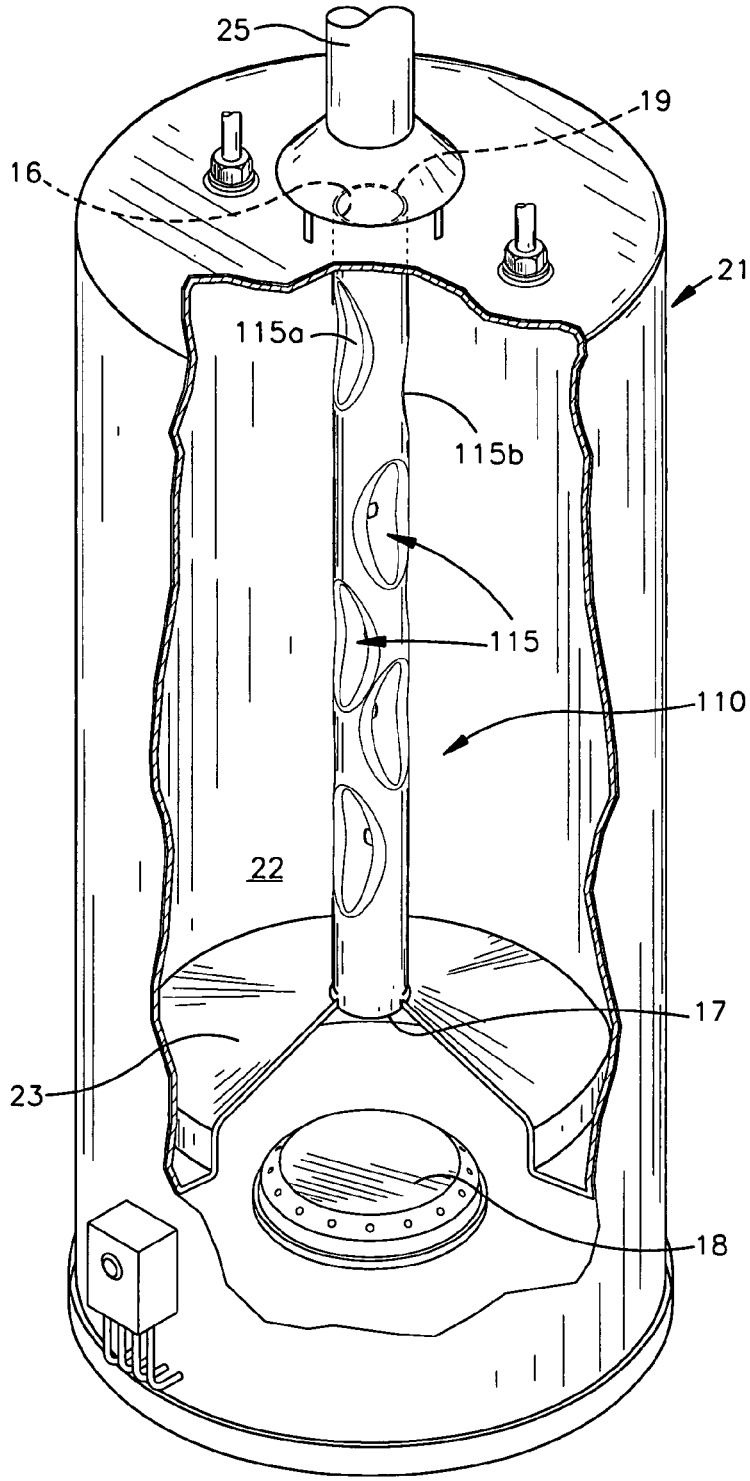
FIG. 14 is a cutaway view of a residential/light commercial water heater having a flue tube of the type shown in FIG. 13.

FIGS. 13 and 14 illustrate another embodiment of this aspect of the invention. In this embodiment, pairs of offset or staggered dimple 115*a*', 115*b*' are arranged along a flue tube 110' in a helix or rotated pattern. In other words, subsequent pairs of staggered dimples are located at rotated positions other than 90° with respect to an adjacent dimple pair. By arranging the staggered dimple pairs in a helix configuration, an increased number of dimples can be formed in a given length of tube 110'. As described above, the overall restriction exhibited by the flue tube 110' is determined by the number of staggered dimple pairs formed in the tube 110' and the depth to which the dimples extend into the interior 110*a* (shown in FIG. 12) of the tube 110.

These latter embodiments have been described as being formed with "paired" dimples that are staggered or offset. It should be understood that the present invention also contemplates dimples which are not precisely aligned. In the preferred alternate embodiment, the dimples 115*a*, 115*b* of a given pair are spaced longitudinally or axially from each other but are aligned transversely (shown best in FIG. 12). In other words, a center plane bisecting one of the dimples of the pair also bisects the other dimple of the pair. If the spacing "X" is reduced to zero, the dimples 115*a*, 115*b* would directly confront each other as seen in the embodiment shown in FIG. 4. However, the invention does contemplate pairs of dimples 115*a*, 115*b* that are not transversely aligned (i.e., one dimple of a pair is offset radically with respect to its associated other dimple of the pair). In other words, a center plane bisecting one of the dimples would not exactly bisect the other dimple of the pair.

It should be apparent that with the present invention, any desired flow restriction in a flue tube can be created by the appropriate selection and positioning of dimples whether they be aligned in pairs, arranged as staggered pairs or randomly positioned. The resulting flue tube can be used in many applications including, but not limited to, hot water tanks of the type shown in FIGS. 7 and 13 as well as furnace applications such as exampled in FIGS. 5, 8 and 9.

The preferred embodiments of the invention have been illustrated and described in detail. However, the present invention is not to be considered limited to the precise construction disclosed. Various adaptations, modifications and uses of the invention may occur to those skilled in the art to which the invention relates and the intention is to cover hereby all such adaptations, modifications, and uses which fall within the spirit or scope of the appended claims.

We claim:

1. A heat exchanger apparatus comprising at least one single piece tubular member having a generally circular cross section, said tubular member further comprising a restricting and turbulating structure, said structure comprising at least one opposing pair of obstructions having a generally parabolic dimple shape disposed within said tubular member, each obstruction having a longitudinal dimension and a transverse dimension, said longitudinal dimension being greater than said transverse dimension, said longitudinal dimension extending in a direction substantially parallel to a center line of said tube and wherein the obstructions of each pair of obstructions are offset with respect to each other each of said obstructions having an innermost region that projects into said tubular member a predetermined distance, and wherein a transverse spacing between the innermost regions of said obstructions is less than or about equal to 12% of the diameter of the tubular member, said predetermined distance being less than or equal to said center line of said tube to form a restricted passage therebetween through which a fluid may flow, the extent of restriction posed by said restricted passage being determined by the longitudinal spacing of the offset obstructions that comprise a pair, said pair of obstructions further forming a pair of adjacent, longitudinally extending, converging, diverging nozzles separated by said restricted passage, each of said nozzles having an aperture through which said fluid flows, said converging, diverging nozzles dividing and conducting fluid flow around said innermost regions of said obstructions.

2. The heat exchanger apparatus of claim 1 wherein said tubular member further includes additional pairs of obstructions spaced from said first pair.

3. The heat exchanger apparatus of claim 1 where at least one of said obstructions projects into said tubular member such that an innermost region of said one obstruction is coincident with a center plane of said tube.

4. The heat exchanger apparatus of claim 1 wherein said obstructions project into said tubular member to at least a center plane of said tubular member.

5. The heat exchanger apparatus of claim 1 wherein said obstructions of a pair are spaced apart from one another in an axial direction by a predetermined distance.

6. The heat exchanger apparatus of claim 1 wherein said opposing pairs of obstructions are located along the sides of said tubular member such that when said tubular member is viewed from one end, said pairs of opposing obstructions are disposed at an angle relative to the vertical axis of said tubular member.

7. The heat exchanger apparatus of claim 2 wherein said additional pairs of obstructions are positioned in a helix pattern along said tubular member.

8. The heat exchanger apparatus of claim 2 wherein said one of said additional pairs of obstructions is rotated 90° with respect to said first pair.

9. The heat exchanger apparatus of claim 2 wherein at least one of said additional pairs of obstructions is rotated at other than a 90° position with respect to said first pair.

10. The heat exchanger apparatus of claim 2 wherein said tubular member comprises a flue tube for a heating appliance.

11. A heat exchanger apparatus comprising an inshot burner and at least one single piece tubular member having a generally circular cross section, said tubular member further comprising a restricting and turbulating structure integral to said tubular member and disposed within said tubular member, said restricting and turbulating structure comprising at least one pair of offset indentations having a generally parabolic dimple shape, each indentation having a longitudinal dimension and a transverse dimension, said longitudinal dimension being greater than said transverse dimension, said longitudinal dimension extending in a direction substantially parallel to a center line of said tube, each of said opposing indentations having an innermost region that extends into said tubular member a predetermined distance, said predetermined distance being less than or equal to the distance to said center line of said tube and wherein a transverse spacing between the innermost regions of said indentations is less than or about equal to 12% of the diameter of the tubular member, said pair of opposing indentations disposed within said tubular member and offset to form a restricted passage therebetween, the extent of restriction posed by said restricted passage being determined by the longitudinal spacing of the offset indentations that comprise a pair, said pair of indentations further forming a pair of adjacent, longitudinally extending, converging, diverging nozzles separated by said restricted passage, each of said nozzles having an aperture through which said fluid flows, said converging, diverging nozzles dividing and conducting fluid flow around said innermost regions of said indentations.

12. The heat exchanger apparatus of claim 11 wherein said indentation project into said tubular member to at least a center plane of said tubular member.

13. The heat exchanger apparatus of claim 11 wherein said indentations of a pair are spaced apart from one another in an axial direction by a predetermined distance.

14. The heat exchanger apparatus of claim 11 wherein said tubular member is bent into a serpentine shape.

15. The heat exchanger apparatus of claim 11 comprising a plurality of said tubular members.

* * * * *